United States Patent [19]

Fowler et al.

[11] 4,007,694

[45] Feb. 15, 1977

[54] UNITARY PLASTIC PALLET FOR HANDLING HEAVY POWDER LOADS

[75] Inventors: Timothy J. Fowler, St. Louis, Mo.; Paul G. Kanan, Watertown, Mass.

[73] Assignee: Monsanto Company, St. Louis, Mo.

[22] Filed: Feb. 15, 1974

[21] Appl. No.: 442,967

[52] U.S. Cl. ..... 108/55.1; 108/901

[51] Int. Cl.[2] ..... B65D 19/04

[58] Field of Search ..... 108/51–58; 248/346; 222/195; 206/386

[56] References Cited

UNITED STATES PATENTS

| | | | |
|---|---|---|---|
| 3,356,264 | 12/1967 | Smith | 222/195 X |
| 3,366,231 | 1/1968 | Trakas | 206/386 X |
| 3,393,646 | 7/1968 | Giacobe | 108/52 |
| 3,424,110 | 1/1969 | Toot | 108/53 |
| 3,561,375 | 2/1971 | Hammond et al. | 108/53 |
| 3,654,875 | 4/1972 | Vik | 108/51 |
| 3,667,403 | 6/1972 | Angelbeck, Jr. | 108/58 |
| 3,719,157 | 3/1973 | Arcocha et al. | 108/58 X |
| 3,776,435 | 12/1973 | Smith | 108/53 X |
| 3,814,031 | 6/1974 | Fowler | 108/51 |

*Primary Examiner*—Roy D. Frazier
*Assistant Examiner*—Lyddane William E.
*Attorney, Agent, or Firm*—Koenig, Senniger, Powers and Leavitt

[57] ABSTRACT

A lightweight, unitary plastic pallet adapted for handling heavy powder loads. The pallet has a substantially rigid lower deck, a flexible, reinforced and continuous upper deck adapted to deflect against the lower deck under load, and a plurality of integral legs permitting forklift transport of the pallet.

2 Claims, 3 Drawing Figures

UNITARY PLASTIC PALLET FOR HANDLING HEAVY POWDER LOADS

FIELD OF THE INVENTION

This invention relates generally to pallets. More particularly it relates to lightweight, unitary plastic pallets adapted for handling heavy powder loads or other applications that require a continuous upper surface on the pallet while permitting no openings into or through the lower surface of the pallet. In another embodiment, the present invention provides a lightweight and partially flexible plastic pallet adapted for handling fluidized bed loads.

BACKGROUND OF THE INVENTION

Load-supporting pallets adapted to be handled by forklift trucks are well known in the art and many enjoy substantial commercial usage. Further, various specialized pallet configurations have been evolved over the years by different industries.

Preferable materials of construction for pallets have traditionally been steel or wood. Wooden pallets were at one time advantageous because of their comparatively low initial cost and low density. There are a number of drawbacks, however, to the use of wooden pallets, particularly in the realm of economics and practicality. From a practical standpoint, wooden pallets are quite difficult to maintain and after a period of time, are rendered ineffective for use when subjected to normal abuse in the trade. Furthermore, when the wooden pallets are used in a normally humid atmosphere or in a location where they are subjected to contact with liquid substances, the wood can rapidly deteriorate. The wooden pallets can therefore have a shorter life than pallets formed of other materials.

Many problems are inherent in the use of wooden pallets in a wide variety of applications. The wooden pallets are constructed by placing the frame members and cover boards in the desired locations and securing the same by means of nails or staples. After some use, however, these metal securement means are ultimately urged out of their point of securement thereby rendering the pallet defective. Vibration, which often results from carrying the pallets on a moving vehicle, causes the nails or other metal fasteners to work out of their fastening positions. Furthermore, the wooden pallets have a substantially greater weight than, for example, a plastic pallet constructed of substantially equal size. Consequently, freight costs are higher when wooden pallets are employed over plastic counterpart pallets.

There has been a recent introduction in the marketplace of pallets formed primarily of plastic materials. These pallets, however, like their wooden counterparts, also suffer from a number of disadvantages. The plastic pallets must include an upper load-supporting surface and a bottom loadsupporting, surface, the latter being provided with some means for contacting the floor or other supporting structure. These two substantially horizontal surfaces must be supported in some fashion to maintain rigidity especially when loaded. The pallets generally include some type of internal rib structure, lattice or web structure to maintain the spacing between the two walls and to provide internal strength. The presently available techniques used in the making of the pallets reside in rotational molding, extrusion blow molding or thermoforming. With the exception of rotational molding, however, molds necessary to produce structures of this type are quite expensive. In many cases, the processes for producing these pallets result in a substantial cost which does not afford any significant economic advantage over wooden pallets.

U.S. Pat. No. 3,667,403 issued June 6, 1972 discloses a two-piece plastic pallet which is said to provide improved properties. The pallet is formed by securing two mating unitary plastic members by means of bolts or other fasteners. The upper and lower surfaces of the assembled pallet have a plurality of apertures extending vertically through the assembly. Such a plastic pallet assembly is clearly unsuited for transporting bulk loads of powdered chemicals and the like.

U.S. Pat. No. 3,563,184 discloses a molded plastic pallet with a top surface disposed over a lower support surface. The two parallel, spaced surfaces are connected and reinforced by rows of aligned apertures and circular webs.

U.S. Pat. Nos. 3,511,191 and 3,140,672 both disclose unitary molded pallets having smooth, continuous upper decks and reinforced lower decks with hollow support legs depending from the lower deck but integrally formed with the pallet.

Providing a unitary plastic pallet light in weight, durable, easily cleaned, nestable, capable of directly supporting heavy powder loads and capable of four-way entry with forklift equipment constitutes one of the principal objects of the present invention. Another object is to provide a pallet of the aforementioned type which is particularly adapted to fluidized bed operation with powdered materials. Still another object is to provide a unitary plastic pallet wherein the upper and lower decks are not joined together with fastening means.

SUMMARY OF THE INVENTION

The present invention is directed to a unitary molded plastic pallet comprising a flexible, structurally strong and continuous upper deck and a stiff, structurally strong, lower deck. Significantly, there are no direct mechanical connections between the upper and lower decks. Because there are no openings from the upper deck into and through the lower deck, the unitary pallet is conveniently adapted for transporting heavy powder loads such as powdered chemicals. Furthermore, the pallet of the present invention features a flexible, structurally strong upper deck which is deformable under load to provide adequate structural integrity in the pallet for transport of heavy loads by forklift equipment. In a preferred embodiment, the flexible plastic pallet is especially suitable for handling fluidized bed loads.

In general, therefore, the present invention is adaptable to large, hollow, unitary members where openings connecting two opposite surfaces are unacceptable, yet where a high degree of structural integrity is required.

DESCRIPTION OF THE DRAWINGS

The present invention is better understood by reference to the accompanying drawings wherein.

DETAILED DESCRIPTION

Figure 1:
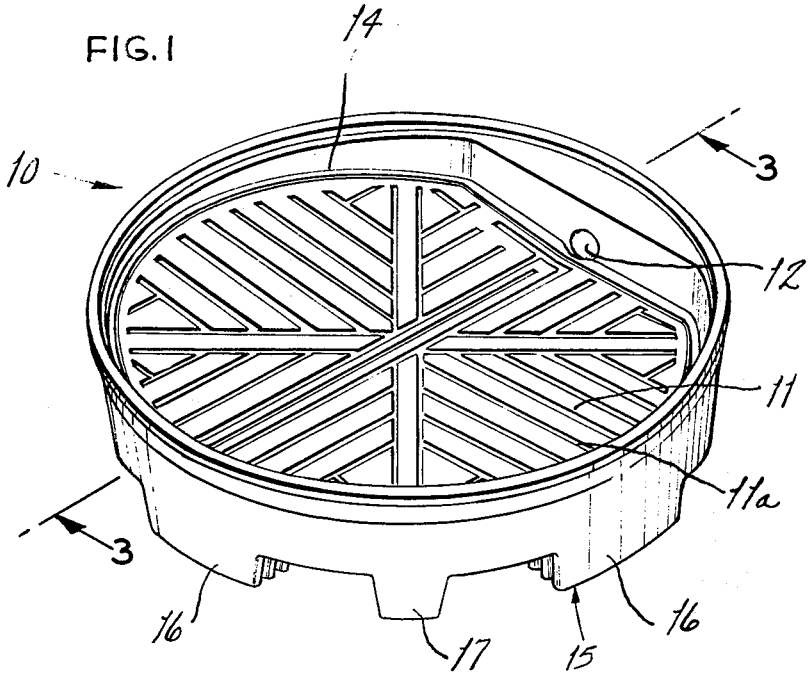
FIG. 1 is a perspective view constructed in accordance with the present invention wherein the flexible, structurally strong upper deck of the unitary plastic pallet is seen.

With reference now to FIG. 1 which illustrates a preferred embodiment of the present invention, the unitary plastic pallet is identified by reference numeral 10. Pallet 10 is generally circular in shape and, in one representative configuration, has an outside diameter of 42 inches.

Pallet 10 can be molded as a unitary member. Alternatively, the upper and lower decks can be separately molded then bonded together at their periphery. Because no direct mechanical connection is required between the two decks, the molding and/or bonding operations are greatly facilitated in comparison to prior art plastic pallets having a continuous upper deck.

The material from which the pallet can be made can be any of a large number of plastic or synthetic resin materials. Both thermosetting as well as thermoplastic materials can be used. Examples of suitable polymers include phenolic resins such as phenolformaldehyde, epoxies, melamine-formaldehyde polyesters, polyethylene, polypropylene, nylon, acrylic resins, polystyrene, polyvinyl chloride and a number of other common and specialty plastics including copolymers and terpolymers such as ABS (acrylonitrile-butadiene-styrene polymer). In addition, the foregoing polymers can be modified with various additives such as plasticizers, stabilizers for protection against thermal, ultraviolet light and other degradation, foaming agents, pigments, fillers and dyes to produce polymer materials with special or improved properties.

Depending upon the polymer material used in the pallet, the method of fabricating the pallet can be quite different. Injection molding is one method commonly used in the manufacture of thermoplastic materials. Other possible methods include extrusion followed by hot or cold stamping. In both an injection molding process and in a stamping process, it will be convenient to form the pallet in two halves and then join the halves to form a unitary structure. Many other processes could also employ the above technique. Included are blow molding, casting and thermoforming. Other processes such as blow molding and rotational molding can be used to manufacture a one-piece pallet in one step without the need for joining two or more portions together. Polyethylene, particularly the high-density type with a density of at least 0.93, is a material particularly preferred for use in the above-described pallets because of its combination of low cost, resistance to environmental use, easy moldability and excellent ductility. When polyethylene is selected as the pallet material, rotational molding is one of the particularly preferred fabrication processes.

With further reference to FIG. 1, the upper deck (top surface) of pallet 10 is identified by reference numeral 11. Upper deck 11 can be substantially horizontal and flat or, in one embodiment, it can be sloped as illustrated in FIG. 1. Preferably, upper deck 11 is formed with a plurality of stiffening corrugations or channel indentations 11*a*. In addition to providing structural strength, corrugations 11*a* are designed to prevent local skin buckling in upper deck 11. Corrugations 11*a* permit the load to be carried to the upper deck support points where it rests on the lower deck. Thus, the combination of flexibility and structural strength in upper deck 11 is essential to providing a structurally strong pallet. The sloped configuration of the illustrated embodiment is adapted to accommodate fluidized-bed handling of powdered or granular chemicals, e.g., for preparing fire retardant chemical solutions near the site of forest fires. However, the unitary plastic pallet of the present invention is adaptable to many and variegated material handling functions such as bulk handling of all types of chemicals in particulate solid form. The fluidized dispensing feature of FIG. 1 merely typifies one specialized application for the pallet.

Turning again to FIG. 1, adjacent to upper deck 11 and disposed near the lowest inclined portion of upper deck 11 is discharge aperture 12 through which the fluidized particles can flow. Annular surface 14 on pallet 10 can accommodate an air-permeable, continuous, circular diaphragm comprising, for example, a textile fabric supported by a rigid grid structure (i.e., supported by the corrugated upper deck 11). The particulate material to be fluidized thus rests upon the diaphragm and is constrained by an upwardly-extending storage bin which (e.g., a cylindric plastic film bag or the like) adapts to the periphery of pallet 10. The space beneath the diaphragm and above upper deck 11 including the upwardly facing corrugations 11*a* in the upper deck forms a plenum chamber for pressurized air. The air from this chamber can pass through the diaphragm and thereupon fluidize the particulate material disposed above the diaphragm. To afford discharge of the fluidized material through aperture 12, a conduit passing through the diaphragm and penetrating into the particulate material can be connected to aperture 12.

Figure 2:
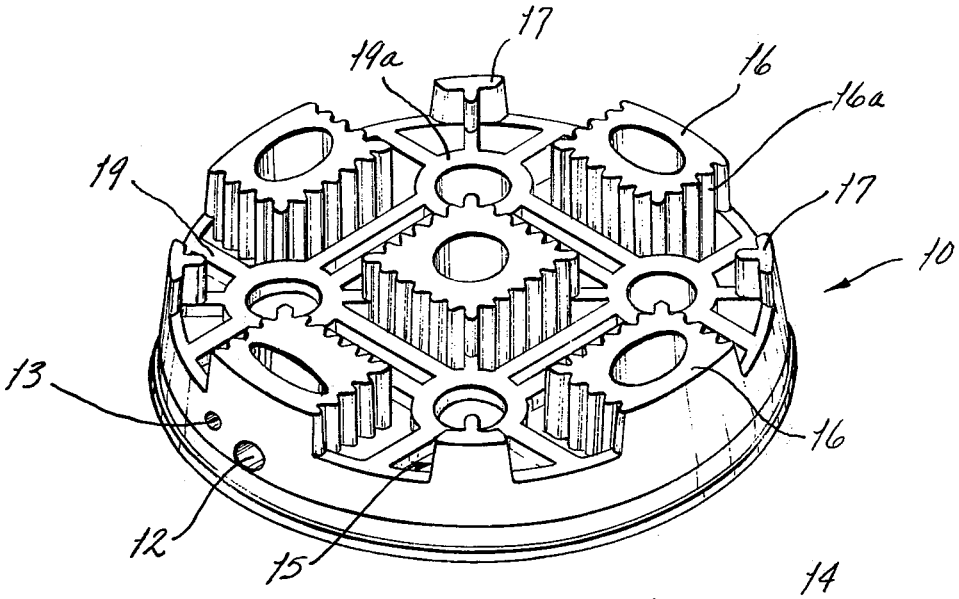
FIG. 2 is a perspective view illustrating the structurally strong lower deck of the unitary plastic pallet.

With reference to FIG. 2, fluidization of the particulate material is achieved by introducing pressurized air to aperture 13 which causes pressurization of the space or plenum chamber above upper deck 11. Aperture 13 connects through upper deck 11 and is positioned so as not to interfere with the flexible action of upper deck 11.

Figure 3:
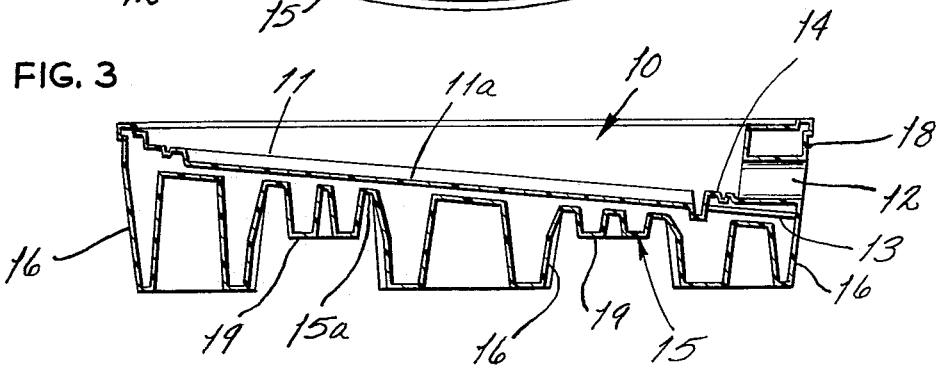
FIG. 3 is a vertical sectional view taken along line 3—3 of FIG. 1 which shows the absence of direct mechanical connection between the upper and lower decks.

The lower deck of pallet 10 is illustrated in FIG. 2 and is identified by reference numeral 15. As indicated at 15*a*, the lower deck has a plurality of the previously described upper deck support points engageable with the upper deck as the latter deflects downwardly under normal load. Lower deck 15 has high structural integrity and is configured so as to enable the pallet load to be carried through pallet 10 either to the ground or to the tines of a forklift truck. In the illustrated embodiment there are nine supporting legs integral with but depending from pallet 10, five of which are major supports as indicated typically by reference numeral 16. The four minor support legs are identified by reference numeral 17. Each of the nine supporting legs is so positioned as to permit entry of forklift tines from any of four positions around the periphery of pallet 10. The circular and elliptical reliefs in the legs terminate in a flat section which provides additional support for upper deck 11. FIG. 3 further illustrates this feature.

Considerable variation is afforded in the number of support legs on the pallets of the present invention. Considering structural design limitations as well as economies in the molding operation, the number of legs is preferably from about four to about twelve, and more preferably nine.

Referring again to FIG. 2, legs 16 and 17 are integrally associated with lower deck 15 and the exterior edge or periphery of pallet 10. Preferably, the legs will be from about 3.5 to about 8 inches in length. The spacing between the legs can vary considerably. Ordinarily the spaces between the legs are at least 3.5 or 4 inches up to about 18 or 24 inches. The legs are advantageously molded with corrugations 16*a* for added strength in column stress and to prevent gross buckling of the legs under load.

With further reference to FIG. 2, reinforcing members 19 project from the exterior surface of lower deck 15 and are molded integrally therewith. Reinforcing members 19 pass between legs 16 and 17 to afford optimum load capacity for lower deck 15. The four circular segments of reinforcing members 19 (identified typically by reference numeral 19*a*) are designed to provide strength where members 19 would normally intersect. To provide pallet strength in two directions, reinforcing members 19 in lower deck 15 are disposed at right angles to corrugations 11*a* in upper deck 11. This relative arrangement has been found to be essential to high structural integrity of the pallet of this invention.

Because of the inclination of the upper and lower decks in the illustrated embodiment, the projected height of reinforcing members 19 varies. This is seen more clearly in FIG. 3. Thus, in the case where the overall height of pallet 10 is ten inches, reinforcing members 19 may vary more than 2 inches in length (height) but will preferably have a floor clearance of three inches.

FIG. 3 illustrates the cross-section of pallet 10 and particularly shows the inclined surface of upper deck 11 and lower deck 15, which inclination promotes gravity scavenging of the powdered material. The comparatively thin cross-section of upper deck 11 is evident in FIG. 3. This affords a significant degree of flexibility to upper deck 11 without detracting from nestability and without compromising the overall structural integrity of pallet 10, yet reducing the overall pallet weight. Peripheral surface 18 is adapted to accommodate a wrapping band for securement of the cylindrical plastic film, or the like, of the storage bin which serves to constrain the bulk particulate material resting upon and being carried by pallet 10.

Thus, pallet 10 provides a unitary member which affords flexibility in upper deck 11 together with structural rigidity in lower deck 15, yet without compromising structural integrity of the assembly. For this reason the pallet of the present invention is especially adapted for handling particulate material whether or not it is desirable to fluidize that material in the dispensing operation.

In a typical embodiment the overall diameter of pallet 10 is approximately 42 inches with a nominal overall height of 10 inches. The average wall thickness is ⅛ inch and the pallet is molded with about 34 pounds of ultraviolet-stabilized high density polyethylene. Approximately ½ inch clearance is provided between upper deck 11 and the portion of lower deck 15 on which it bottoms under load deflection. Thus, the limits of vertical travel of upper deck 11 due to load deflection are predetermined by the pallet interior design.

Regarding the pallet decks, they can be 1/16 inch or less up to one inch or more in thickness, depending upon the maximum load the pallet is designed to sustain. Pallets capable of carrying loads of 4 to 5 pounds per square inch can be designed with upper and lower decks of ⅛ inch thicknesses. It is often convenient to make hollow pallets with all wall thicknesses, including the legs and exterior edge walls, identical. For certain applications, however, it may be desirable to manufacture the pallet with some walls thicker than others. As an example, the upper and lower decks of the pallet can be molded ⅛ inch thick and the walls of the legs much thicker such as ½ inch or more.

The overall pallet height, that is the distance between the upper and lower extremities of the pallet, can vary widely. The preferred embodiment illustrated herein conveniently supports and handles 2,000 pounds of powdered chemicals.

It should be understood that changes and modifications in the design of the pallet shown herein by rearrangement, elimination or addition to its component parts can be made without departing from the spirit and scope of this invention. For instance, the inclined attitude of the upper and lower decks is not a prerequisite. Also, there is wide latitude in configuration of reinforcing members 19. There is similar latitude in stiffening corrugations 11*a*. The rigid lower deck, although continuous (without apertures) in the drawings herein, could contain apertures if desired in certain embodiments.

The embodiments of this invention in which an exclusive property or privilege is claimed are defined as follows:

1. A load carrying pallet comprising a hollow, unitary plastic structure having a reinforced, substantially rigid lower deck, a flexible, reinforced and substantially continuous upper deck separated from said lower deck but deformable under normal loads to rest on said lower deck, the reinforcements on said lower deck and said upper deck being disposed in essentially parallel planes but being nonparallel in direction, an exterior wall extending above said upper deck and bridging said upper and lower decks, and a plurality of reinforced legs integrally associated with said lower deck while adapted to permit forklift transport of said pallet, said upper deck and lower deck being substantially parallel to each other but inclined with respect to the bottom surface of the pallet legs.

2. A load carrying pallet comprising a hollow, unitary plastic structure having a reinforced, substantially rigid lower deck, a flexible reinforced and substantially continuous upper deck separated from said lower deck but deformable under normal loads to rest on said lower deck, the reinforcements on said lower deck and said upper deck being disposed in essentially parallel planes but being nonparallel in direction, an exterior wall extending above said upper deck and bridging said upper and lower decks, and a plurality of reinforced legs integrally associated with said lower deck while adapted to permit forklift transport of said pallet, said pallet further having an aperture passing through the pallet exterior wall and in communication with the space above the upper deck.

* * * * *